US006763750B2

(12) United States Patent
Lindee

(10) Patent No.: US 6,763,750 B2
(45) Date of Patent: Jul. 20, 2004

(54) CONVEYOR SYSTEM FOR SLICER APPARATUS

(75) Inventor: Scott A. Lindee, Mokena, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 10/072,338

(22) Filed: Feb. 7, 2002

(65) Prior Publication Data

US 2003/0145700 A1 Aug. 7, 2003

(51) Int. Cl.[7] ..... B26D 7/06
(52) U.S. Cl. ..... 83/88; 83/155; 198/468.11
(58) Field of Search ..... 83/88, 155, 155.1, 83/158, 161, 730, 932; 198/468.01, 468.11, 575, 577

(56) References Cited

U.S. PATENT DOCUMENTS

| | | | | |
|---|---|---|---|---|
| 2,969,099 A | | 1/1961 | Gillman | |
| 3,428,102 A | | 2/1969 | Knecht et al. | |
| 3,636,828 A | | 1/1972 | Achelpohl | |
| 3,834,259 A | | 9/1974 | Kuchler | |
| 3,855,889 A | | 12/1974 | Wiley et al. | |
| 3,870,139 A | | 3/1975 | Wagner | |
| 3,910,141 A | | 10/1975 | Divan | |
| 3,948,153 A | | 4/1976 | Dutro et al. | |
| 3,965,783 A | | 6/1976 | Miiller et al. | |
| 4,018,326 A | | 4/1977 | Hardy | |
| 4,079,644 A | | 3/1978 | Hoke et al. | |
| 4,135,616 A | | 1/1979 | Pellaton | |
| 4,185,527 A | | 1/1980 | Kuchler | |
| 4,196,646 A | | 4/1980 | Mukumoto | |
| 4,217,650 A | | 8/1980 | Kuchler | |
| 4,258,530 A | * | 3/1981 | Mukumoto | 83/88 X |
| 4,280,614 A | | 7/1981 | Balch et al. | |
| 4,371,076 A | | 2/1983 | Nakao | |
| 4,379,416 A | | 4/1983 | Kuchler | |
| 4,522,292 A | | 6/1985 | Euverard et al. | |
| 4,598,618 A | | 7/1986 | Kuchler | |
| 4,684,008 A | | 8/1987 | Hayashi et al. | |
| 4,760,765 A | | 8/1988 | Nishimoto et al. | |
| 4,793,228 A | | 12/1988 | Etter et al. | |
| 4,846,336 A | | 7/1989 | Hoyland et al. | |
| 4,926,999 A | | 5/1990 | Fauth, Sr. et al. | |
| 5,125,303 A | | 6/1992 | Hoyland | |
| 5,168,978 A | | 12/1992 | Cox et al. | |
| 5,205,367 A | | 4/1993 | Andre et al. | |
| 5,209,339 A | | 5/1993 | Antonissen | |
| 5,423,250 A | | 6/1995 | Anderson et al. | |
| 5,649,463 A | | 7/1997 | Lindee et al. | |
| 6,196,097 B1 | * | 3/2001 | Handel | 83/77 |

FOREIGN PATENT DOCUMENTS

| | | |
|---|---|---|
| DE | 324874 | 11/1974 |
| DE | 326514 | 2/1975 |
| DE | 28 20 618 | 12/1978 |
| DE | 386 794 | 3/1998 |
| EP | 0 634 325 B1 | 1/1995 |
| EP | 0 713 753 A2 | 5/1996 |
| WO | WO 00/59689 | 12/2000 |

* cited by examiner

*Primary Examiner*—James R. Bidwell
(74) *Attorney, Agent, or Firm*—The Law Office of Randall T. Erickson, P.C

(57) ABSTRACT

A conveying surface for a slicing apparatus that can be moved in two orthogonal directions in a coordinated manner to allow a depositing of slices in a pattern on the conveying surface. The conveying surface can be an endless belt conveyor circulated in the longitudinal direction by a servo-motor via a telescopic drive shaft and shifted in the lateral direction by servo-motor driving a crank arm mechanism.

39 Claims, 16 Drawing Sheets

380
366
368
330
326
334
270

366
380
330
326
368
270

CONVEYOR SYSTEM FOR SLICER APPARATUS

TECHNICAL FIELD OF THE INVENTION

The present invention relates to slicing apparatus and associated conveyor systems. Particularly, the invention relates to a conveyor system that includes a mechanism for arranging slices received from the slicing apparatus in a manner to form a pattern.

BACKGROUND OF THE INVENTION

Slicing apparatus and associated conveyor systems are known wherein the slicing apparatus deposits slices on a "jump conveyor." The jump conveyor includes a longitudinally arranged conveying surface that travels slowly in a longitudinal direction during slice deposition to accumulate a shingled stack of slices, or the conveying surface can be held stationary to accumulate a vertically aligned stack. The jump conveyor is intermittently accelerated longitudinally to create a longitudinal gap or spacing between successive stacks. Such arrangements are disclosed, for example, in U.S. Pat. Nos. 5,649,463; 5,704,265; EP 0 713 753; or WO 99/08844, all herein incorporated by reference. Slicing apparatus and conveyor systems are also embodied in the FORMAX FX180 Slicer available from Formax, Inc. of Mokena, Ill., U.S.A.

SUMMARY OF THE INVENTION

The invention provides a slicing apparatus and an associated conveyor system that allows a deposition of slices in a pattern on a conveying surface. The patterns can be two-dimensional patterns that can thereafter be packaged on a tray to provide an aesthetically pleasing display package of slices for retail sale. In order to arrange the two-dimensional patterns, the conveying surface is moveable in horizontal orthogonal directions, longitudinally and laterally, in accordance with a preprogrammed routine.

The conveying surface can be moved longitudinally and laterally in both forward and reverse directions to create the patterns. After a pattern is deposited onto the conveyor, the conveying surface is intermittently accelerated longitudinally to produce a gap between adjacent patterns for purposes of packaging.

The conveyor can advantageously be a jump conveyor as described in the aforementioned patents and further modified to allow for lateral movement. The jump conveyor movements can be controlled using the machine programmable controller. The patterns can be operator selected, and the conveying surface movements can be controlled by the controller.

The invention provides a selectable variety of aesthetically pleasing slice display patterns. Such patterns include, but are not limited to: an "S" shaped pattern, an "X" shaped pattern, a square pattern, a diamond pattern, a square/round pattern, a circular pattern, and a triangular pattern. The patterns can be formed by shingling or stacking slices, one slice resting partially on top of the preceding slice, to densely pack the pattern with the slices.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
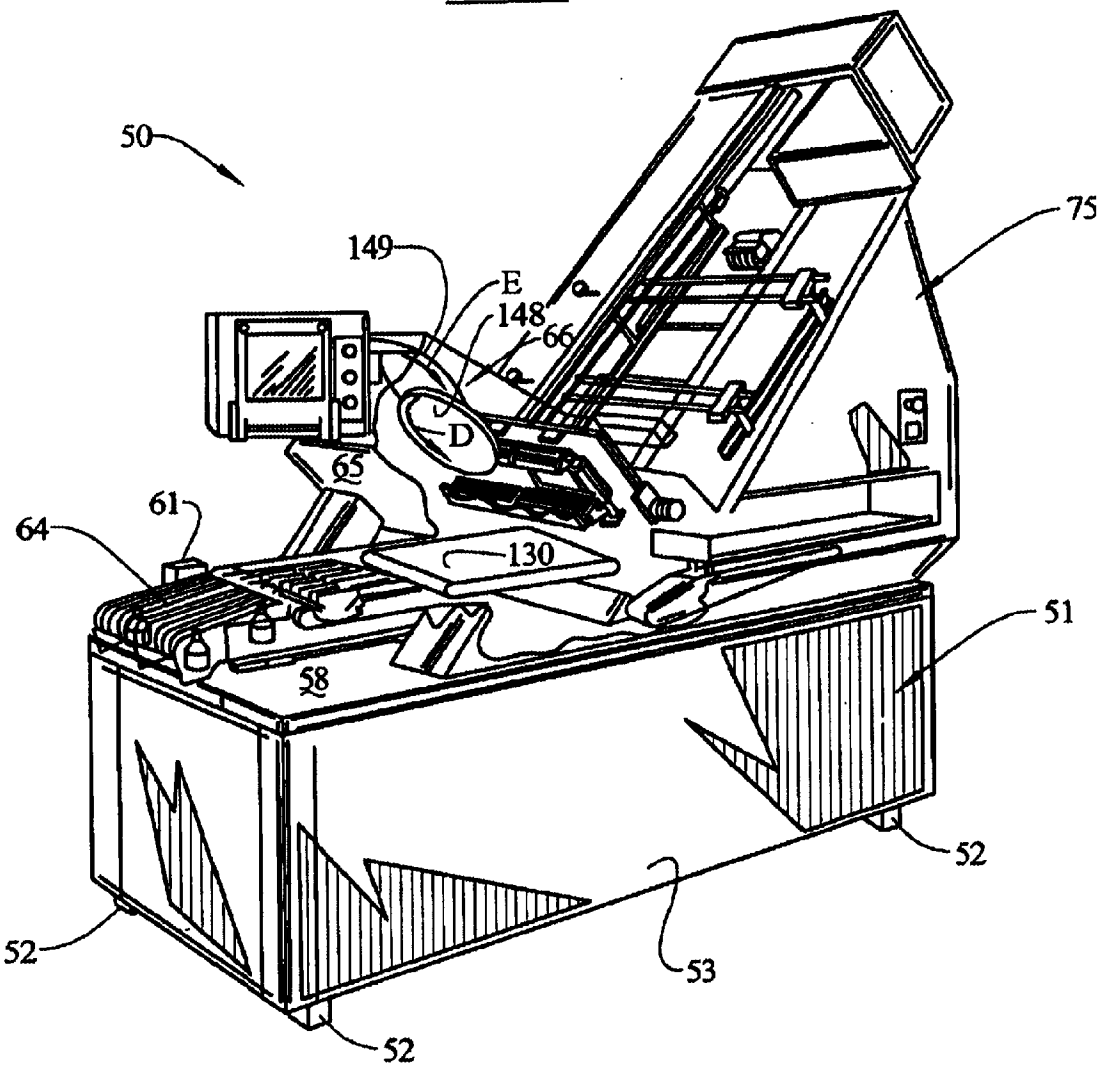
FIG. 1 is a fragmentary, partially schematical, perspective view of a slicer apparatus and associated conveyor system of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a versatile high-speed food loaf-slicing machine 50. Such a machine is generally disclosed, for example, in U.S. Pat. Nos. 5,704,265; 5,649,463; or in EP 0 713 753 A2; or WO 99/08844, all herein incorporated by reference. The slicing machine 50 comprises a base 51 mounted upon four fixed pedestals or feet 52, and a housing or enclosure 53 surrounding by a top 58. The enclosure can house an operating computer, an electrical power supply, a scale mechanism, and a pneumatic or hydraulic pressurized fluid supply, or both (not shown). The slicing machine 50 includes a conveyor drive 61 used to drive an output conveyor/classifier system 64.

The slicing machine 50 includes a fixed frame supporting an automated feed mechanism 75 for feeding food loaves into a slicing station 66. The slicing station 66 includes a rotating spindle or head 148. The head 148 is driven to rotate clockwise, as indicated by arrow D. The range of head speeds is quite large and may typically be from 10 to 750 rpm. A round knife blade 149 is shown rotatively mounted at a non-centralized location on the head 148. The knife blade 149 is driven separately from the head 148, rotating clockwise in the direction of arrow E. The blade 149 thus performs an orbital motion and also rotates. Other slicing head configurations may be used in machine 50, such as one of the designs disclosed in WO 99/08844.

The slicing machine 50 produces a series of vertical stacks or shingled stacks of food loaf slices that are moved outwardly of the machine, in a direction of the arrow A, by the conveyor/classifier system 64. The conveyor/classifier system 64 includes a jump conveyor 130, shown schematically, which receives slices directly from the slicing system 66.

Figure 2:
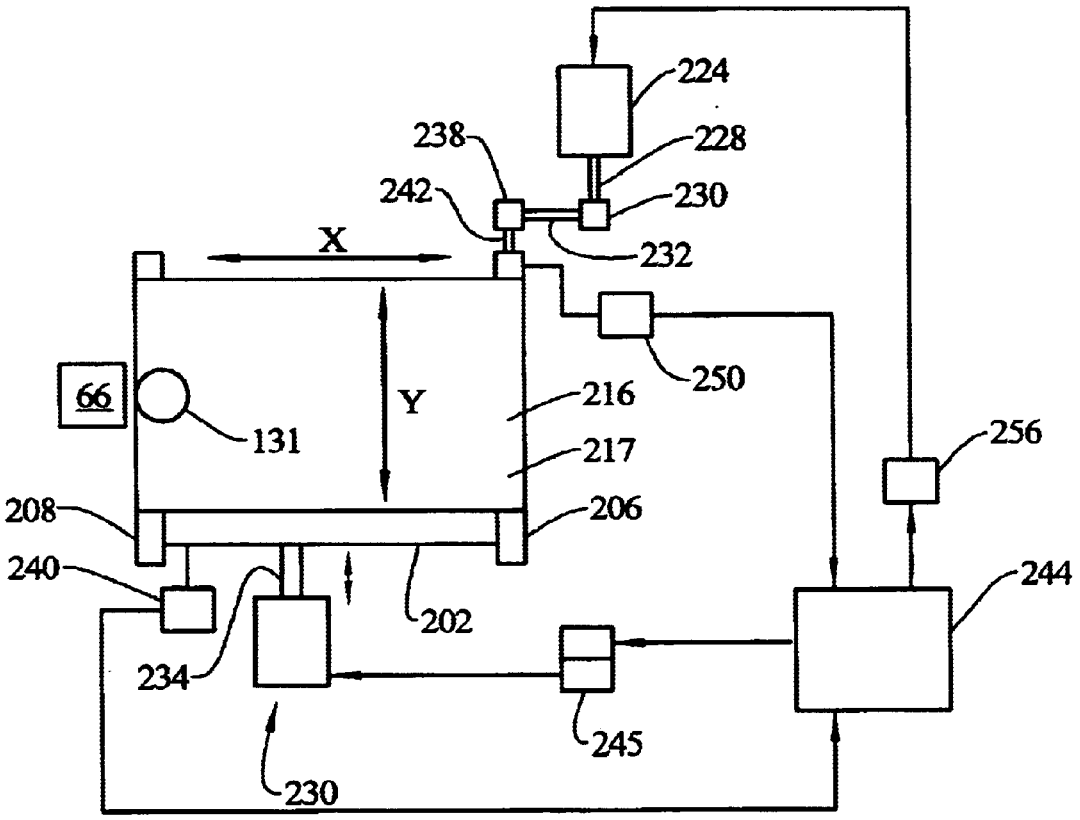
FIG. 2 is a schematic diagram of the slicer apparatus and conveyor system of FIG. 1.

FIG. 2 illustrates in schematic fashion, the jump conveyor 130. The conveyor 130 receives slices from a fixed position 131 of the slicing system 66. The jump conveyor includes a frame 202 carrying a front roller 206 and a rear roller 208. A conveying surface 216 is provided by a belt 217 that is wrapped around the rollers 206, 208. The front roller 206 is driven to rotate by a motor 224, via an output shaft 228, a first pulley 230, a belt 232, a second pulley 238, and an input shaft 242 connected to the front roller 206.

The conveying surface 216 is shown schematically as a wide belt, but could also be a plurality of spaced apart ribbons or ropes as shown in U.S. Pat. No. 5,649,463. The conveyor 130 can be connected to a raising and lowering system as disclosed in U.S. Pat. No. 5,649,463.

The conveyor 130 is connected to one or more lateral direction moving devices such as a pneumatic cylinder 230 including an actuating rod 234. Extension or retraction of the rod 234 moves the conveyor along the direction Y. A position sensor 240 provides a position feedback signal corresponding to the position of the conveyor surface 216, to a controller 244. The controller 244 sends a control signal via an electric/pneumatic valve 245 to the cylinder 230 to move the conveyor 130 along the direction Y.

The cylinder 230 is operative to move the conveyor in both a forward direction (upwardly as shown in FIG. 2) and in a reverse direction (downwardly as shown in FIG. 2).

The conveying surface 216 is moved in the direction X by the motor 224. A position sensor 250 is connected to the roller or other moving elements to send a position signal to the controller 244. The controller 244 sends a corresponding driving control signal via a signal conditioning component or driver 256 to the motor 224. The position sensor 250 can be a numerical counter, a Hall effect sensor or other element that is typically used to sense rotary position or travel.

The motor 224 is operative to move the conveying surface 216 in both a forward direction (to the right in FIG. 2) and in a reverse direction (to the left in FIG. 2).

The controller 244 accurately positions the conveying surface 216 in both the X and Y directions while receiving slices from the fixed position 131 of the slicing system 66 to create the patterns shown in the following FIGS. 8–14.

According to the preferred embodiment, the conveying surface has a working area (X,Y) of about 9 inches (229 mm) by 9 inches (229 mm). The movement magnitudes ($\Delta X$,$\Delta Y$) are preferably 5 inches (127 mm) by 5 inches (127 mm).

Figure 3:
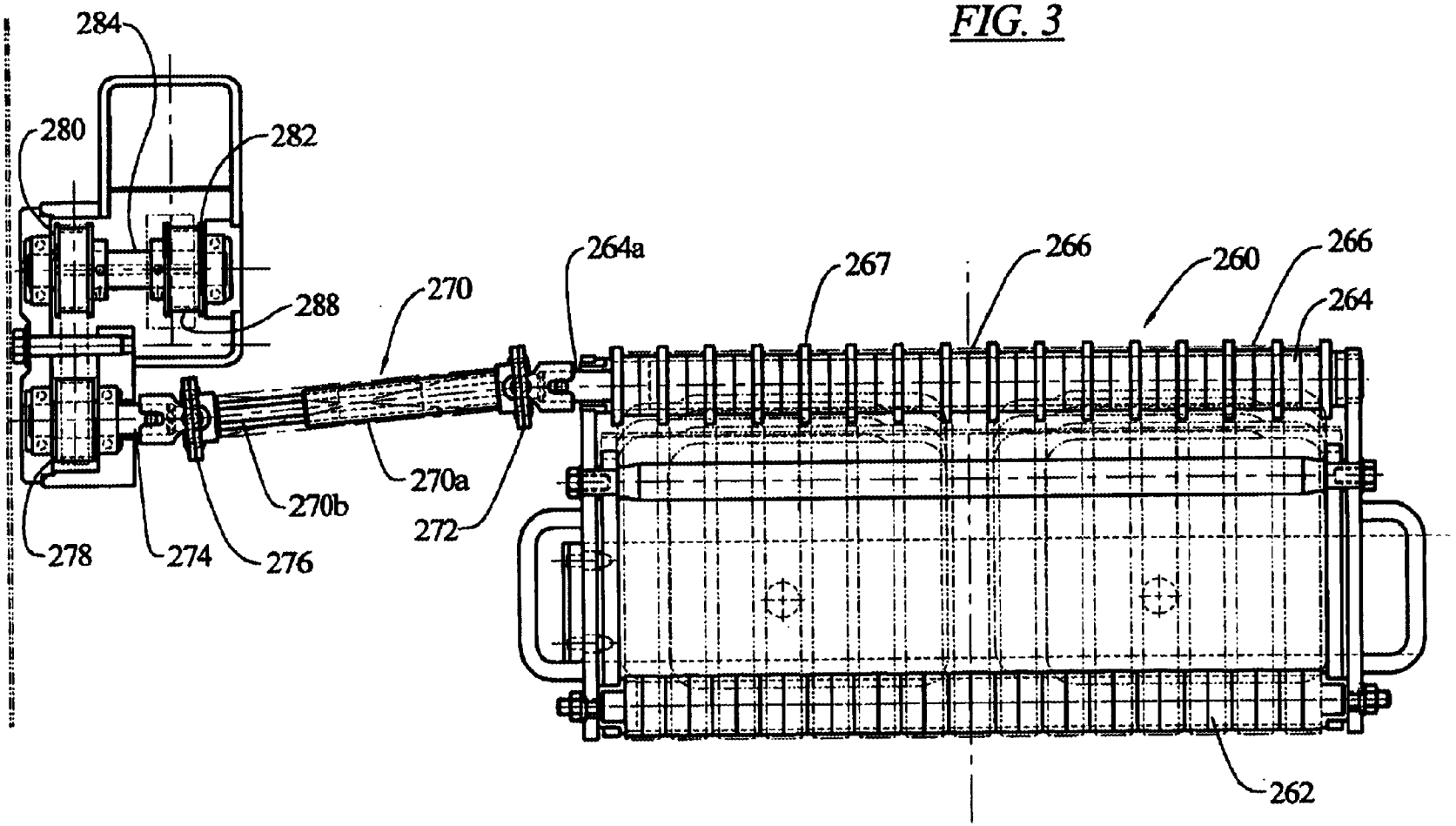
FIG. 3 is a plan view of an exemplary embodiment of the present invention.

FIG. 3 illustrates an exemplary alternate embodiment jump conveyor 260. The conveyor includes front and rear rolls 262, 264 and belts 266 wrapped around the rolls at spaced intervals. The belts 266 provide the conveying surface 216. The rear roll 264 includes rings 267 that ensure spacing of the belts 266. The rear roll 264 is driven to rotate by a telescopic drive shaft 270. The drive shaft 270 includes an outer tube 270*a* and an inner tube 270*b* telescopically arranged to shorten or lengthen the effective length of the drive shaft 270. The drive shaft 270 is connected via a universal or ball joint 272 to an end 264*a* of the roll 264. The drive shaft 270 is connected at an opposite end thereof to a pulley shaft 274 via a universal or ball joint 276. The pulley shaft 274 is fixed to a pulley 278.

An intermediate pulley 280 and driven pulley 282 are both fixed on a second pulley shaft 284. A belt 286 is wrapped around the pulleys 278, 280. Another belt 288 is wrapped around the driven pulley 282 and extends downwardly.

Figure 4:
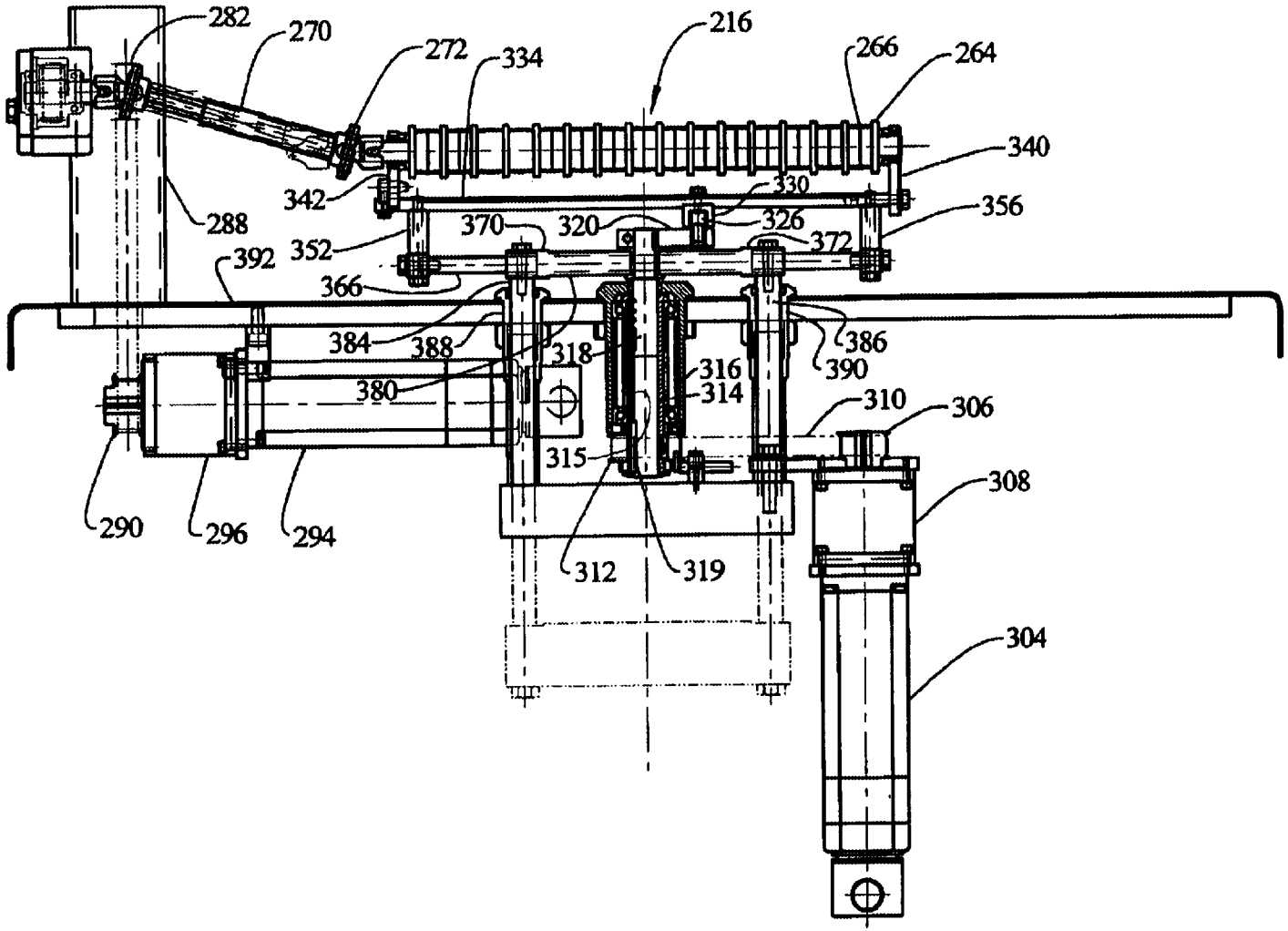
FIG. 4 is a sectional view taken generally along line 4—4 of FIG. 3.

FIG. 4 illustrates the belt 288 wrapped around the driven pulley 282 and a drive pulley 290. The drive pulley 290 is precisely rotated by a servo-motor 294 via a gear box or gear reducer 296.

In lieu of the pneumatic cylinder 230, the lateral movement of the jump conveyor can be accomplished by a servo-motor driven system such as a linear ball screw arrangement or a crank system. In a linear ball screw arrangement, the conveyor rolls would be carried on a frame that is connected to a threaded carrier or nut that is threaded onto a threaded shaft. The threaded shaft would be rotated in a precise fashion to advance the carrier and thus shift the conveying surface 216 laterally in a select direction by a select amount. A crank system is described below.

A servo-motor 304 precisely rotates a drive pulley 306 via a gear box or gear reducer 308. A belt 310 is wrapped around the drive pulley 306 and a driven pulley 312. The driven pulley 312 is fixed to a crank tube 314 that is rotationally journalled within a housing 316. A crank shaft 318 is telescopically received within the crank tube 314. The shaft 318 includes a key 319 which slides within a keyway 315 in the tube 314 to ensure conjoint rotation of the shaft 318 and tube 314 but allows the shaft 318 to be extendable telescopically vertically from the position shown in FIG. 4 to an elevated position (FIG. 4A), under force from an actuator as will be hereafter described.

A crank arm 320 is fixed to an of the crank shaft 318, such as by a keyed arrangement. The crank arm 320 carries a pin or roller 326 at a distal end thereof. The pin 326 is guided within an inverted U-shaped cross-section, cross-member 330. The cross member 330 is connected to a conveyor frame member 334. As will be hereinafter explained, rotation of the pulley 306 by the motor 304 causes rotation of the crank arm 320 via the belt 310, the pulley 310, the crank tube 314, and the crank shaft 318. Rotation of the crank arm 320 orbits the pin 326 that laterally shifts the cross-member 330 and thus the frame 334.

The frame 334 is connected to sidewalls 340, 342 that carry the rolls 262, 264 and permit relative rotation therewith. The frame 334 is supported by vertical members 350, 352, 354, 356 (shown in FIGS. 4, 5 and 5A). The vertical members comprise tubes held in place by threaded fasteners. The vertical members 350, 352, 354, 356 are connected to cross-members 360, 362 which are connected to parallel rails 366, 368. The rails 366, 368 are slidably guided between arms 370, 372, 374, 376 of an H-shaped frame 380. The H-shaped frame is supported on two rods 384, 386 that are moveable vertically through seals 388, 390 carried by a conveyor skin 392 to adjust the elevation of the conveyor. The rails 366, 368 are supported by the H-shaped frame 380.

Figure 4A:
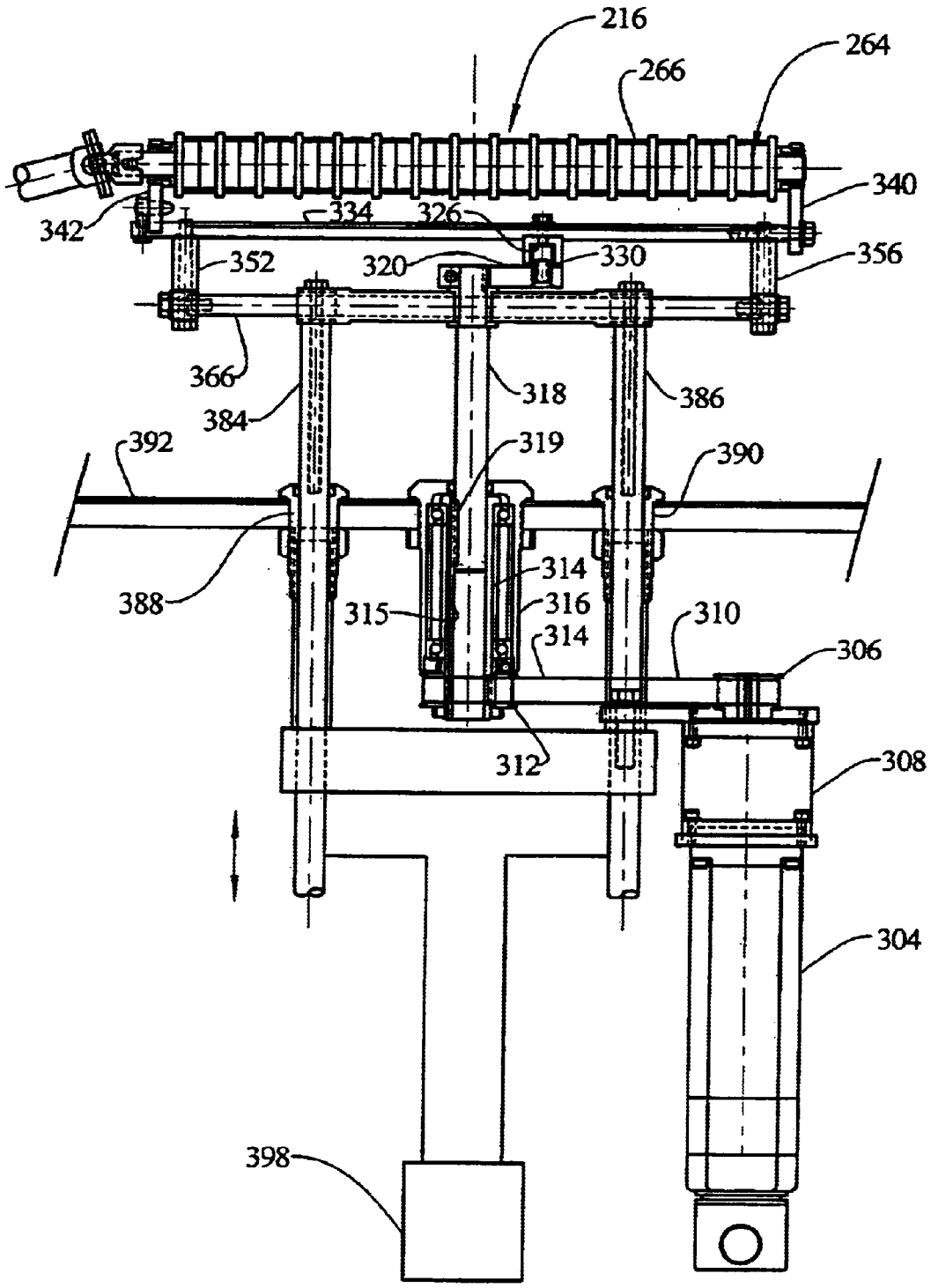

FIG. 4A illustrates the conveying surface 216 in an elevated position compared to FIG. 4. The rods 384, 386 have been lifted by an actuator 398 as described in U.S. Pat. No. 5,649,463, herein incorporated by reference. The shaft 318 has been extended through the tube 314, the key 319 sliding up, but remaining in, the keyway 315. The motor

304, gearbox 308, pulleys 306, 312, belt 310, tube 314 and housing 316 remain at a constant elevation.

Figure 5:
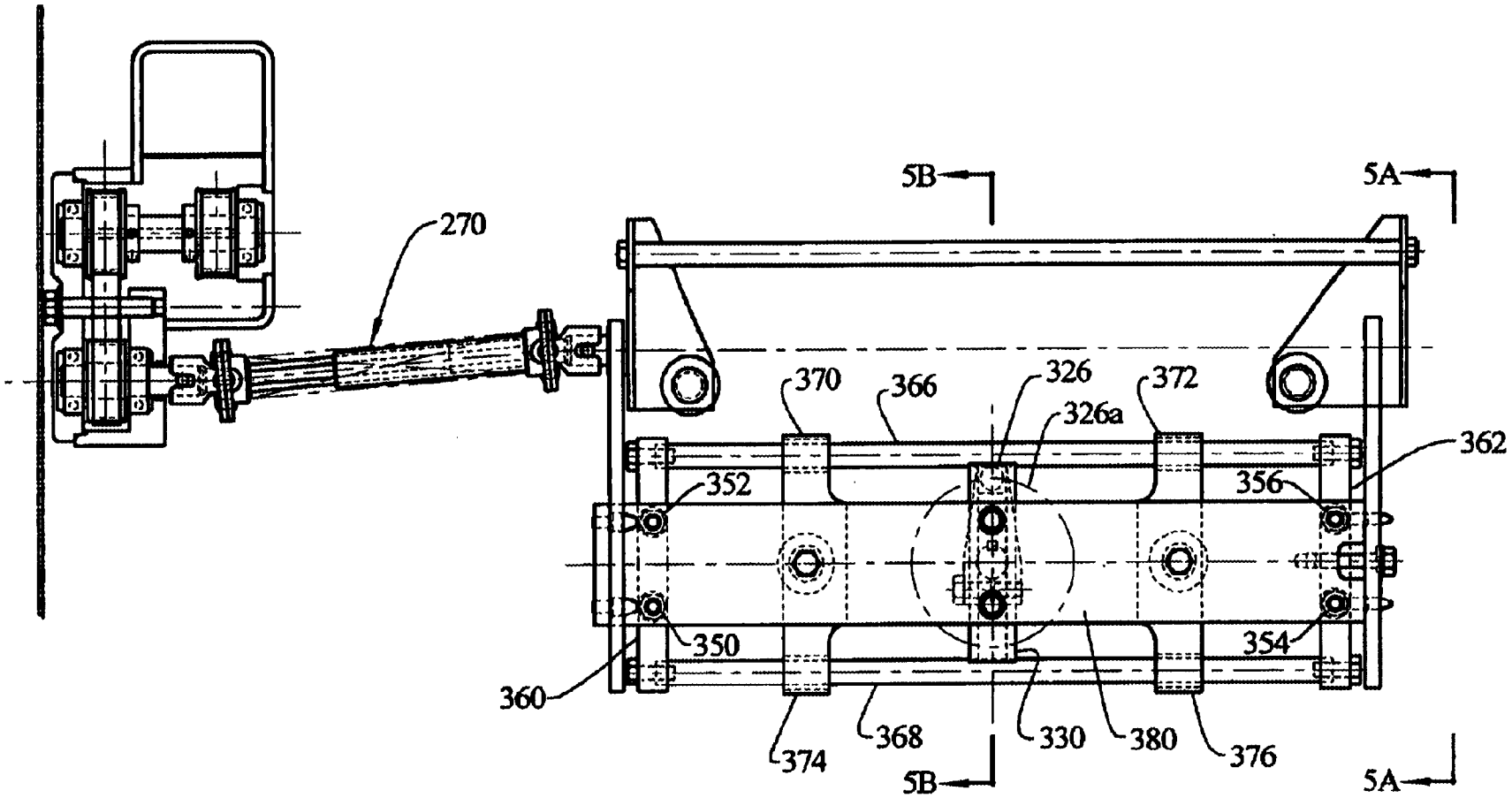
FIG. 5 is a sectional view taken generally along 5—5 of FIG. 4.

FIG. 5 illustrates the conveyor with the conveying surface moved including the rolls and the conveyor belts, to show the underlying structure. The crank arm 320 is shown in an intermediate position. The pin is rotated to the 90° point around its orbit path 326*a*. The rails 366, 368 are substantially centered with respect to the H-shaped frame 380.

Figure 5B:
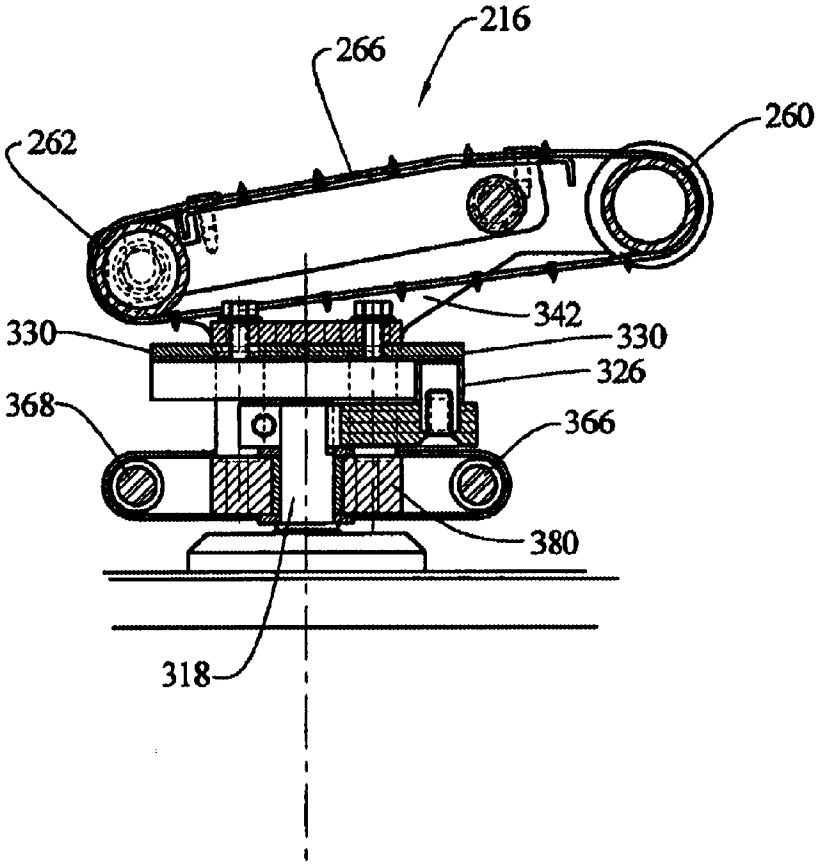
Figure 5A:
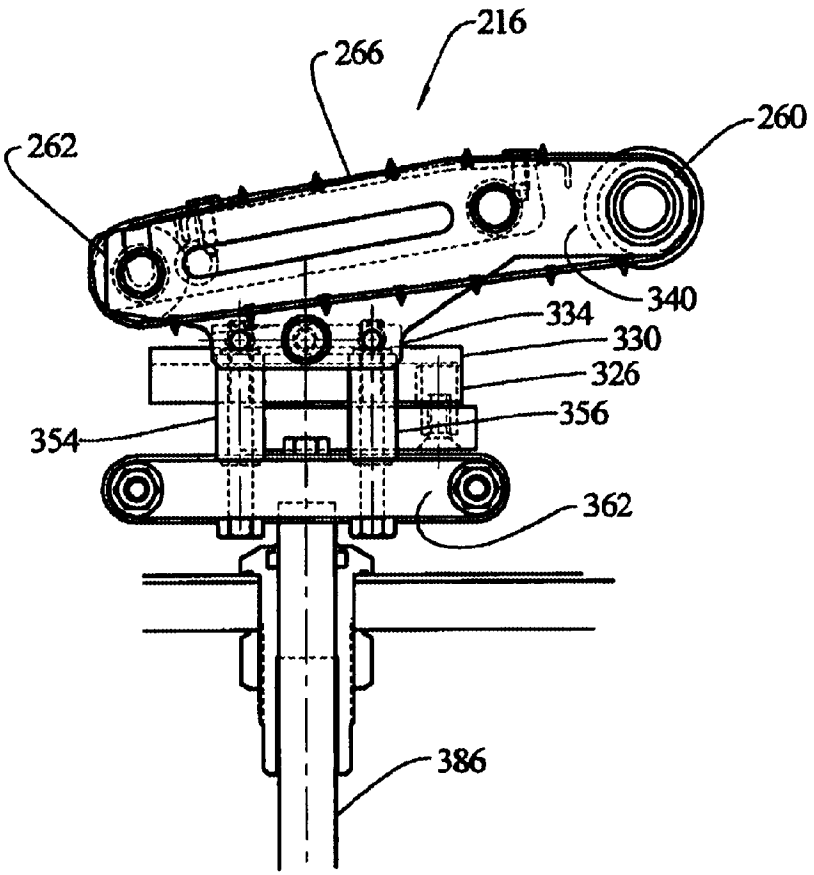

FIGS. 5A and 5B further illustrate the structure of the conveyor 260. The sidewalls 340, 342 are supported on the frame 334. The cross member 330 is fastened to the frame 334 by fasteners.

Figures 6, 7:
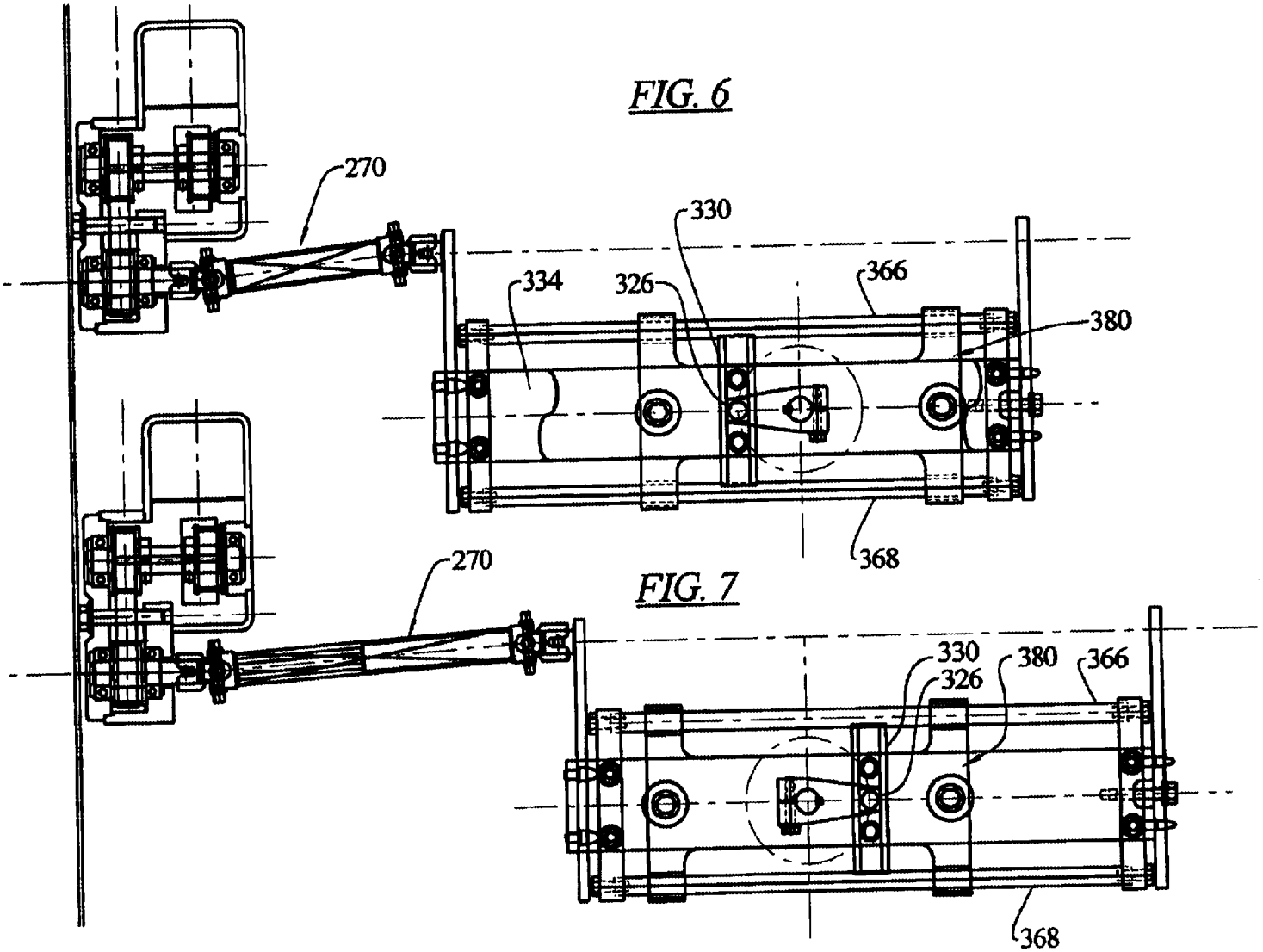
FIG. 6 is a view similar to FIG. 5 but showing the conveyor in a laterally shifted position.
FIG. 7 is view similar to FIG. 6 but with the conveyor laterally shifted in an opposite direction.

FIG. 6 illustrates the crank arm rotated such that the pin 326 is at the 180° point of its orbit 326*a*. The pin 326 has driven the cross-member 330 and rails 366, 368 to the left, to a maximum left side position.

FIG. 7 shows the crank arm rotated such that the pin is at the 0° point of its orbit 326*a*. The pin 326 has driven the cross-member 330 and the rails 366, 368 to the right to a maximum right side position.

As can be seen when viewing the FIGS. 5–7, the telescopic drive shaft increases and decreases in length to compensate for the lateral shifting of the rails 366, 368 and the roll 264 carried thereby. The drive shaft 270 also compensates for variable elevation of the conveyor 260. The elevation of the conveyor is continuously adjusted as stacks of slices are built up, such that each slice falls an equal vertical amount to be deposited on the jump conveyor or on the previous slice. The conveyor and telescopic drive shaft are removable for cleaning and sanitizing.

The controller 244 controls the precise rotation of the servomotors 294, 304 in forward and reverse directions to coordinate movement of the conveying surface 216 longitudinally and laterally to form two dimensional patterns in the X and Y directions. The servomotors include position feedback for precise, controlled degrees of rotation.

Figure 8:
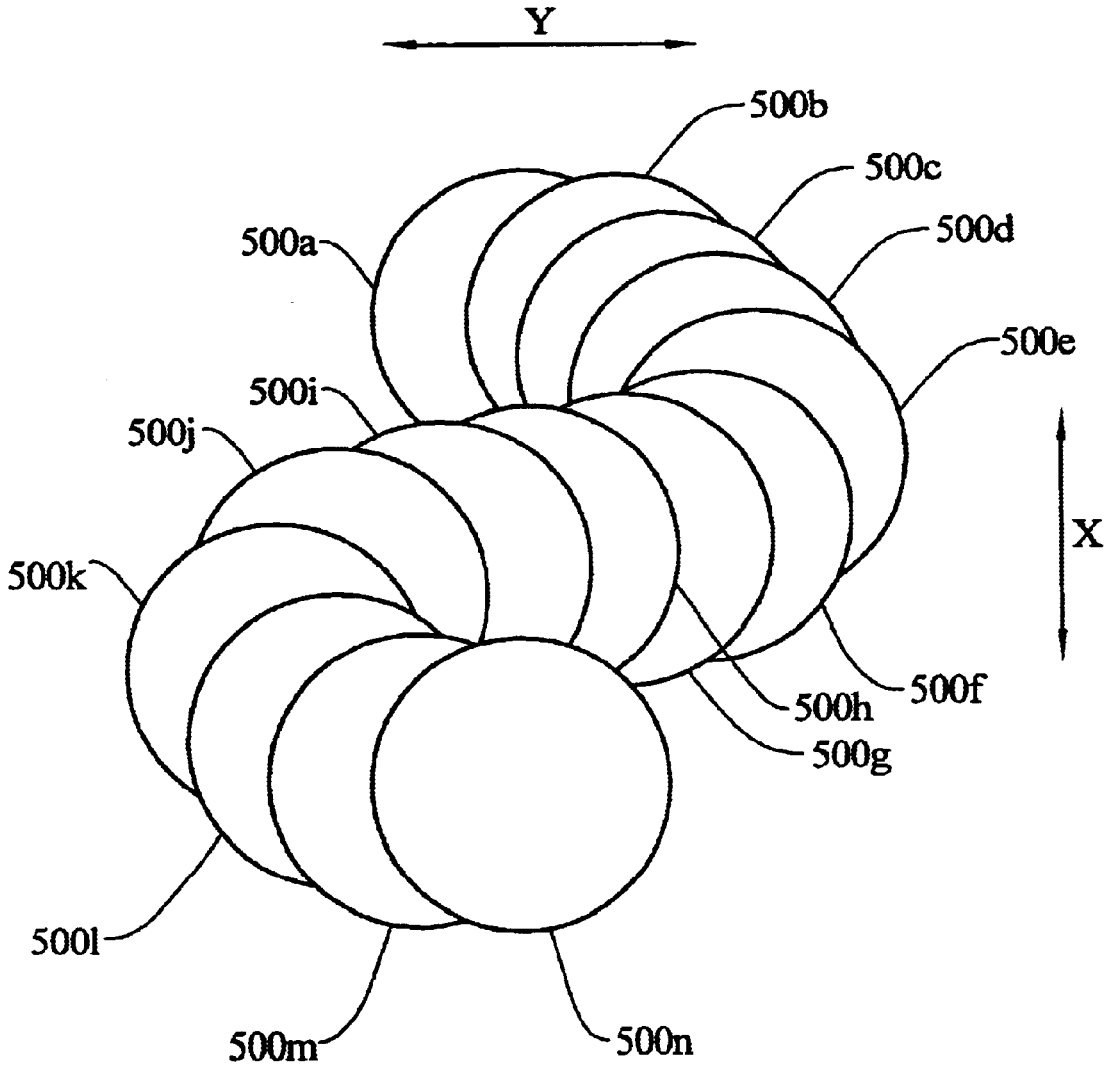
FIG. 8 is a plan view of a first pattern of slices according to the invention.

FIG. 8 illustrates an S-shaped pattern of slices 300. To form this pattern, the conveying surface 216 is oscillated slowly forward and reverse while the conveying surface 216 is progressed in the forward direction X, depositing in order the slices 300*a* to 300*n*.

Figure 9:
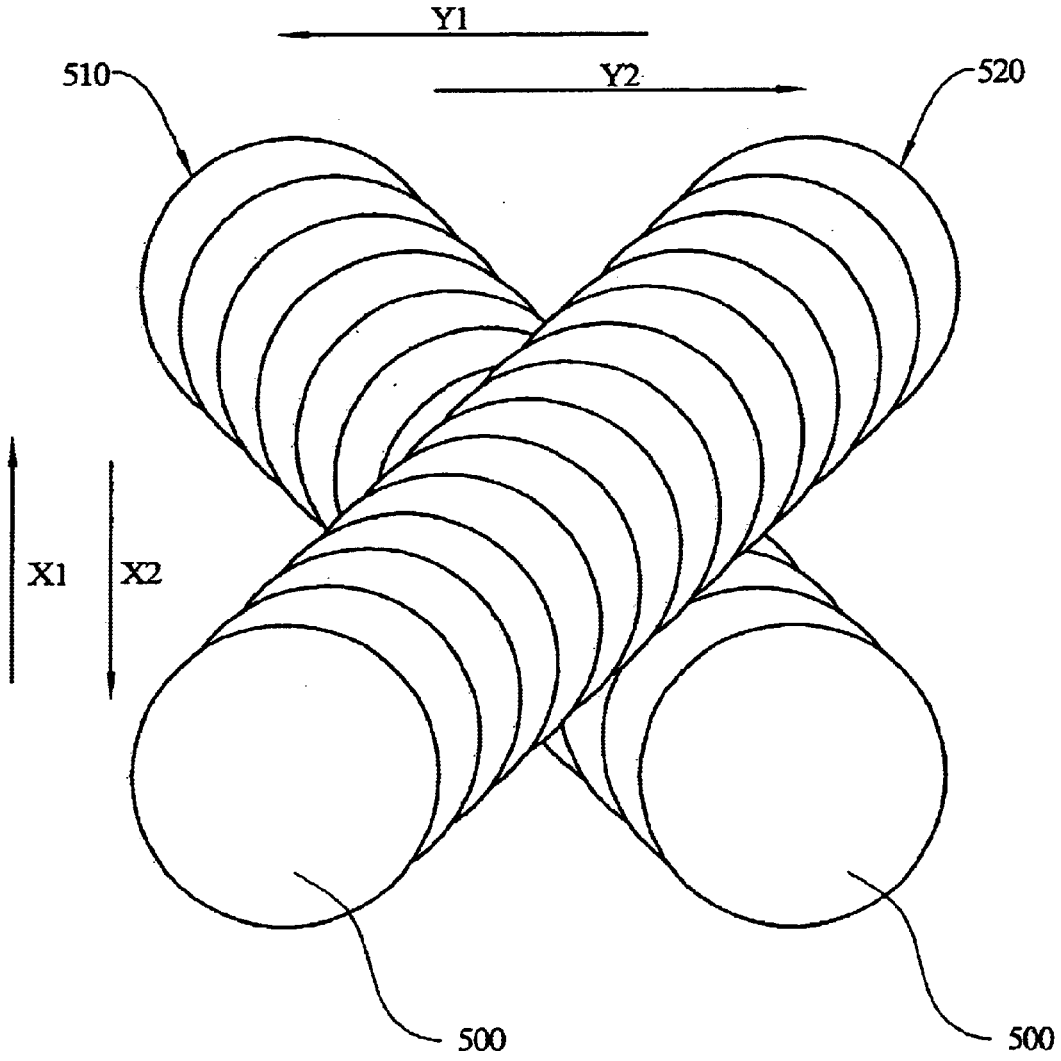
FIG. 9 is a plan view of a second pattern of slices according to the invention.

FIG. 9 illustrates an X-shaped pattern of slices 300 wherein a first stream 310 of slices is shingled by moving the conveying surface 216 forward in the longitudinal direction X1 as the surface 216 is moved laterally in the direction Y1. Subsequently, the surface is retracted in the direction X2 and a second stream 320 is shingled by moving the surface 216 forward in the longitudinal forward direction X1 and the lateral direction Y2.

Figure 10:
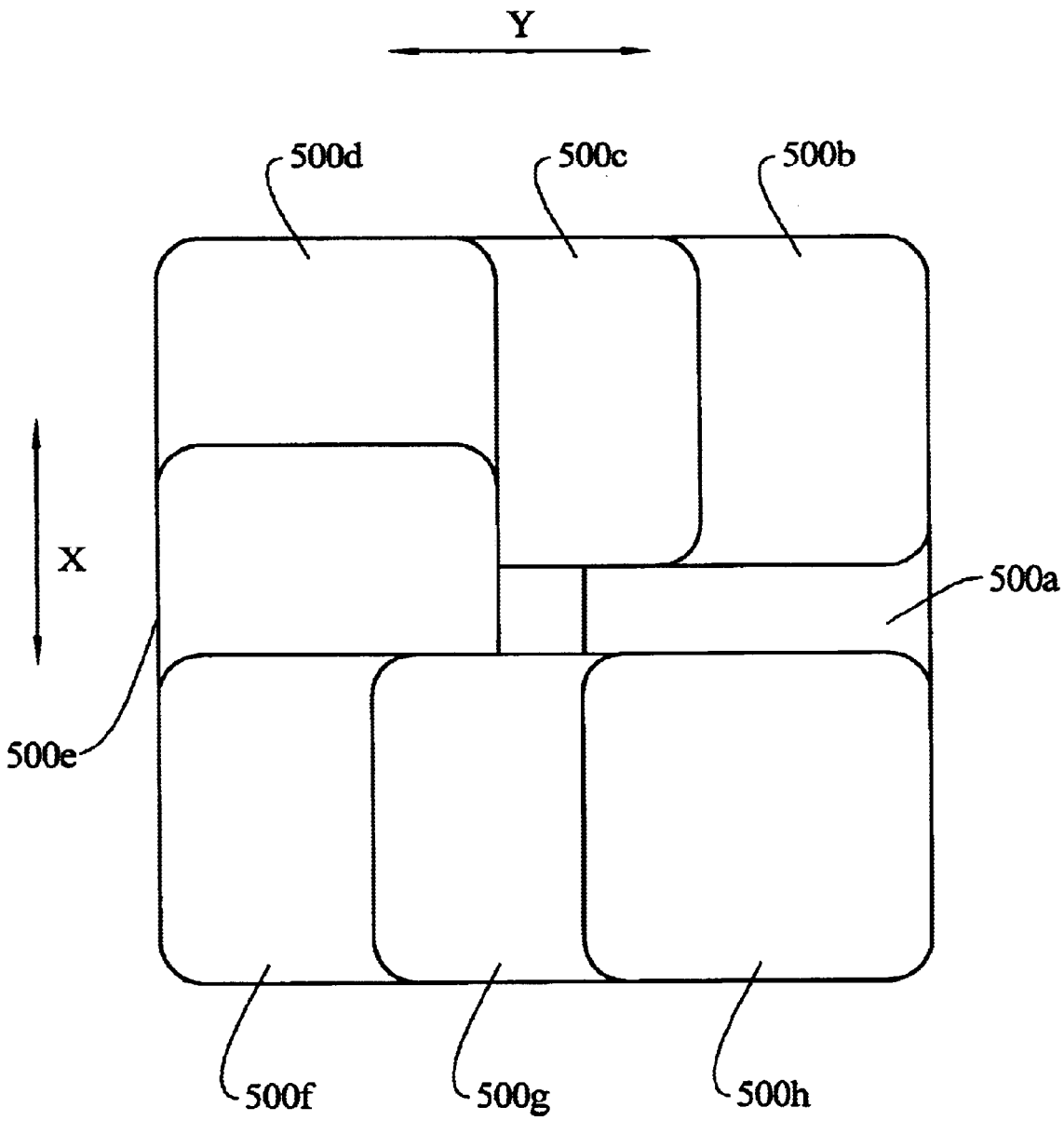
FIG. 10 is a plan view of a third pattern of slices according to the invention.

FIG. 10 illustrates a square pattern of slices 300 formed by first depositing, in order, slices 300*a* to 300*h* around a square by coordinating the Y and X movements in both forward and reverse directions.

Figure 11:
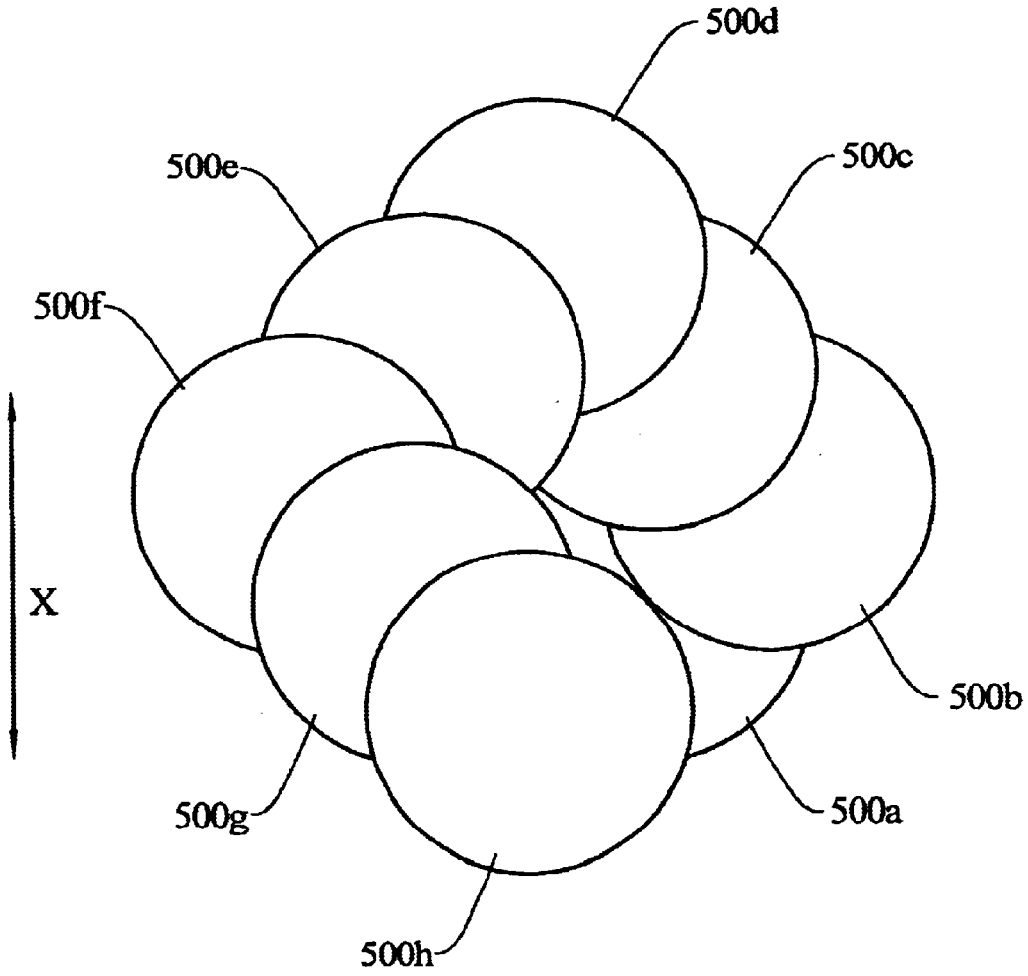
FIG. 11 is a plan view of a fourth pattern of slices according to the invention.

FIG. 11 illustrates a diamond pattern of slices 300 formed by depositing, in order, slices 300*a* to 300*h* around a diamond pattern by coordinating the Y and X movements in both forward and reverse directions.

Figure 12:
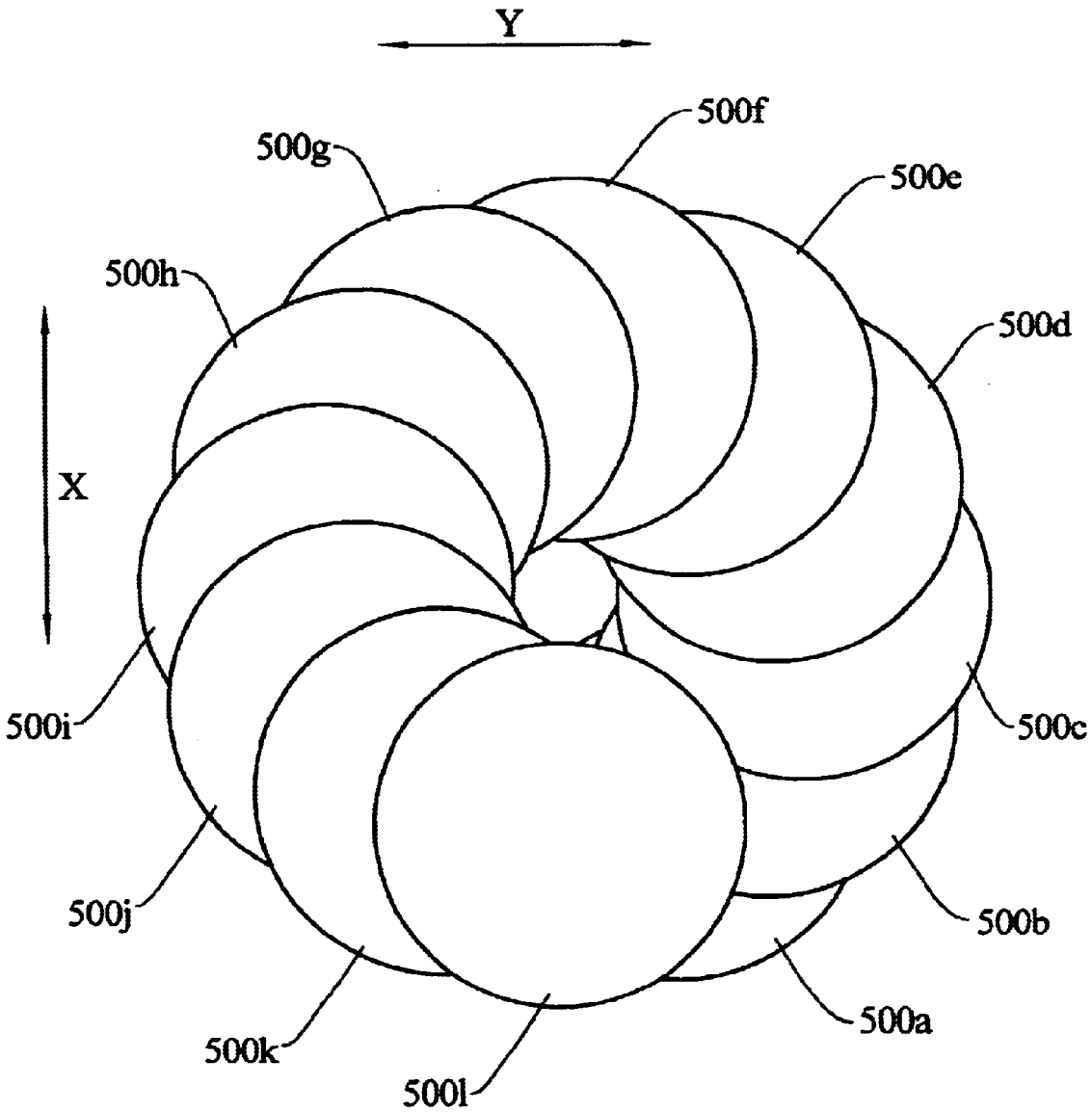
FIG. 12 is a plan view of a fifth pattern of slices according to the invention.

FIG. 12 illustrates a square/round pattern of slices 300 formed by depositing, in order, slices 300*a* to 300*h* around a square circle by coordinating the Y and X movements in both forward and reverse directions.

Figure 13:
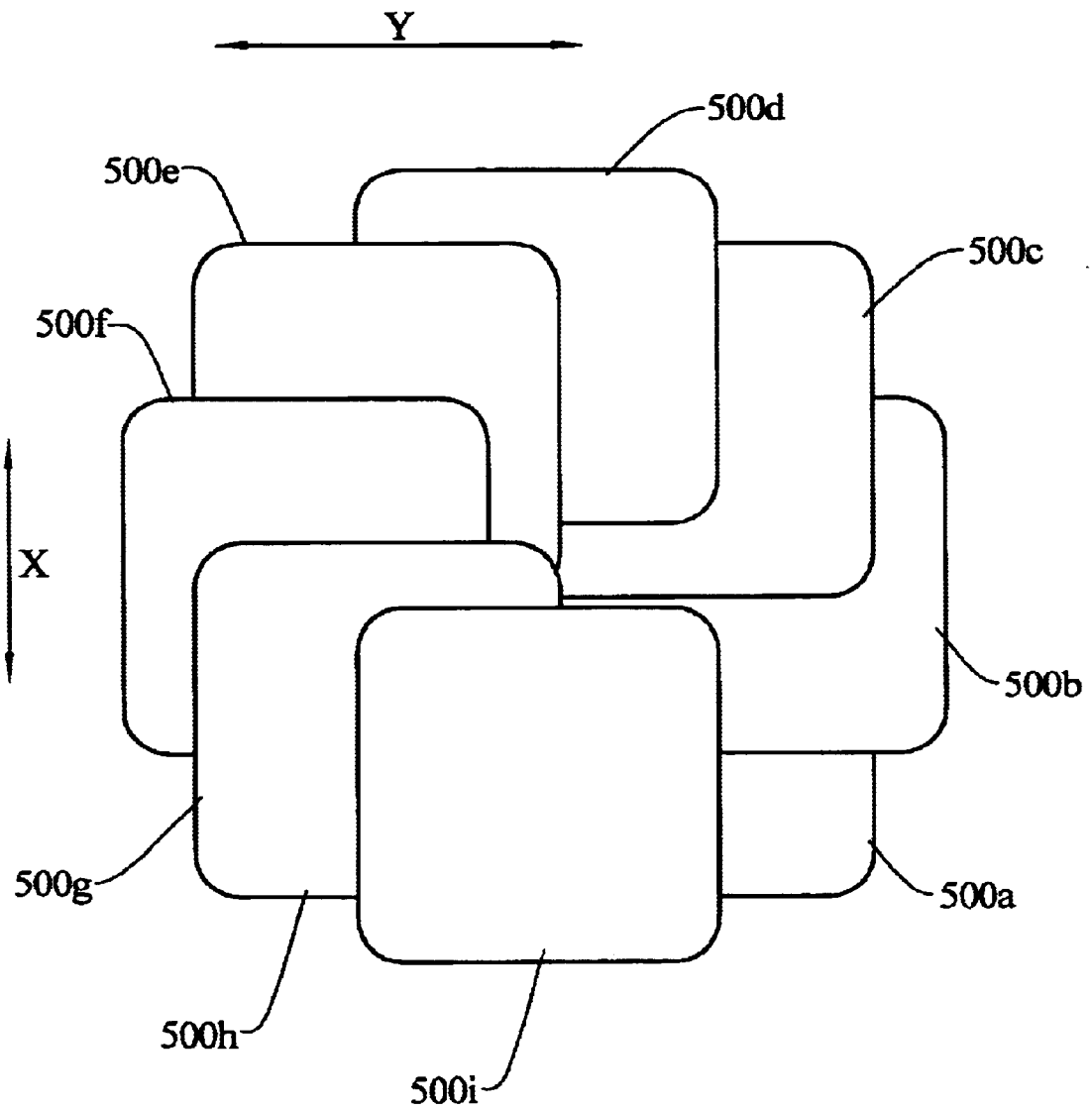
FIG. 13 is a plan view of a sixth pattern of slices according to the invention.

FIG. 13 illustrates a circular pattern of slices 300 formed by depositing, in order, slices 300*a* to 300*h* around a circle by coordinating the Y and X movements in both forward and reverse directions.

Figure 14:
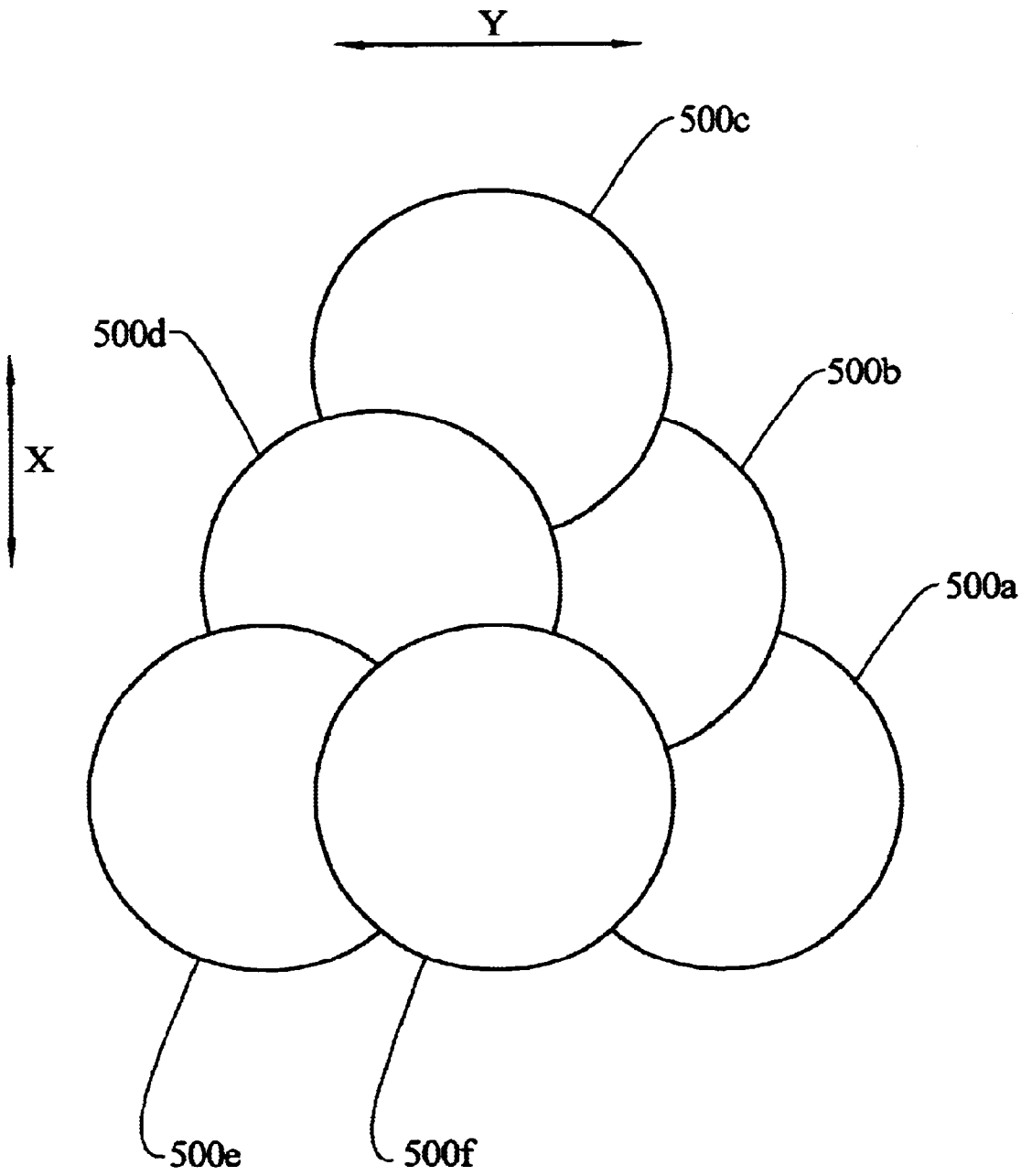
FIG. 14 is a plan view of a seventh pattern of slices according to the invention.

FIG. 14 illustrates a triangle pattern of slices 300 formed by depositing, in order, slices 300*a* to 300*h* around a triangle by coordinating the Y and X movements in both forward and reverse directions.

Figure 17:
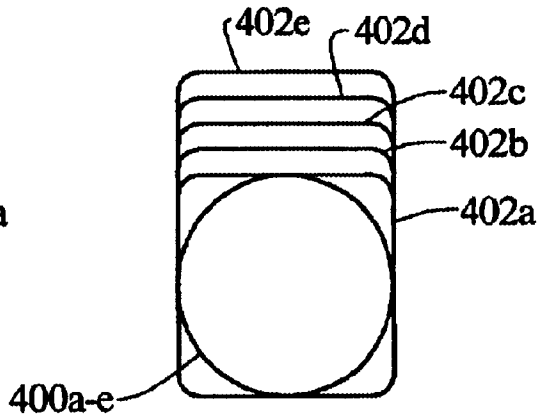
FIG. 17 is a plan view of a tenth pattern of slices according to the invention.
Figure 16:
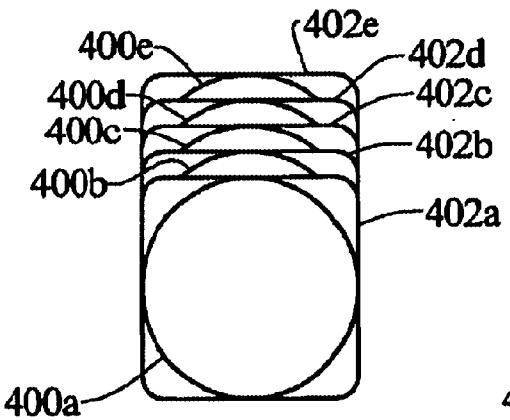
FIG. 16 is a plan view of a ninth pattern of slices according to the invention.
Figure 15:
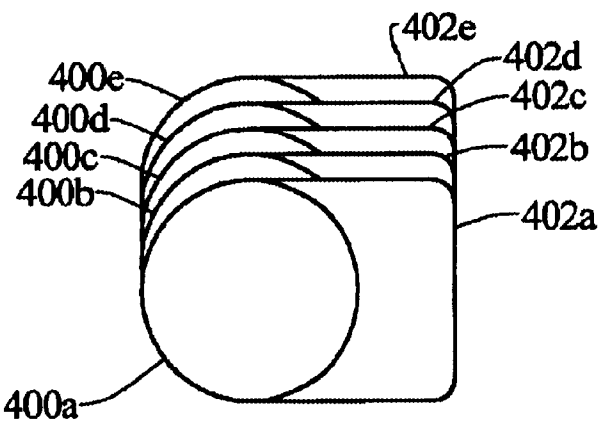
FIG. 15 is a plan view of an eighth pattern of slices according to the invention.

As an alternative to forming two-dimensional patterns, the jump conveyor can be laterally shifted to receive and interleave different products cut from different loaves in a stacked or shingled arrangement such as illustrated in FIGS. 15–17.

In a dual independent feed slicer that can slice two side-by-side loaves simultaneously, such as described in U.S. Pat. No. 5,704,265, or EP 0 713 753 A2, both herein incorporated by reference, using the loaf feed mechanisms to selectively slice each loaf, the jump conveyor of the present invention can be synchronized with the slicer to interleave or group slices of different loaves in a common pattern, straight stack or shingled stack.

FIG. 15 illustrates an offset interleaved shingled stack of round cheese slices 400*a*–*e* and square ham slices 402*a*–*e*.

FIG. 16 illustrates an aligned, interleaved shingled stack of round cheese slices 400*a*–*e* and square ham slices 402*a*–*e*.

FIG. 17 illustrates a grouped arrangement of five round cheese slices 400*a*–*e* and five, shingled square ham slices 402*a*–*e*.

Alternative to the arrangement shown in FIGS. 15–17, wherein a cheese product and a meat product are interleaved or grouped, in a straight stack or shingled, the loaves could be, for example, two different cheese products or two different meat products.

In operation, to develop the arrangement of FIGS. 15–17, the conveying surface 216 is moved rapidly laterally such that a receiving location on the surface 216 moves between deposit positions from the two loaves, to form an interleaved, grouped straight stack, shingled stack or mixed straight and shingled stack. It is also encompassed by the invention that the longitudinal movement of the conveyor is controlled such that the shingled arrangement of FIGS. 15–17 are instead straight stacks or any of the patterns shown in FIGS. 8–14.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method of stacking slices sliced from two different product loaves comprising the steps of:

slicing first and second loaves of two different products, said loaves arranged side-by-side;

depositing a first slice from said first loaf to be supported on a conveyor; and moving said conveyor laterally to deposit a second slice of said second loaf at least partially onto said first slice.

2. The method according to claim 1, wherein said conveyor is moved laterally repetitively and said loaves are sliced at a preselected rate to interleave slices of said first and second loaves in a stack.

3. The method according to claim 2, wherein said conveyor is controlled to move longitudinally such that said stack is shingled.

4. The method according to claim 3, wherein said conveyor is moved laterally and said step of slicing is timed as between loaves, such that a first plurality of slices of said first loaf are deposited in succession on said conveyor and then said first and second slices are deposited at least partly on said first plurality, a second plurality of slices of said second loaf are deposited in succession at least partly on said second slice.

5. The method according to claim 4, wherein said conveyor is controlled to move longitudinally such that at least one of said pluralities are shingled.

6. A conveying system for a slicing apparatus, comprising:

a conveying surface arranged to receive slices from a slicing apparatus;

a first mechanism for moving said conveying surface in a longitudinal direction in both forward and reverse;

a second mechanism for moving said conveying surface in a lateral direction in both forward and reverse; and a control for coordinating movement of said first and second mechanisms to deposit a two dimensional pattern of slices on said conveying surface;

wherein said conveying surface is located on an endless belt, said endless belt is wrapped around front and rear rolls, said first mechanism comprising a motor operatively connected to one of said rolls for circulating said endless belt, said motor connected to said one roll via a telescopic drive shaft, said telescopic drive shaft extended or retracted to compensate for the moving of said conveying surface in the lateral direction.

7. A conveying system for a slicing apparatus, comprising:

a conveying surface arranged to receive slices from a slicing apparatus;

a first mechanism for moving said conveying surface in a longitudinal direction in both forward and reverse;

a second mechanism for moving said conveying surface in a lateral direction in both forward and reverse; and a control for coordinating movement of said first and second mechanisms to deposit a two dimensional pattern of slices on said conveying surface;

wherein said conveying surface is located on an endless belt, and said second mechanism comprises a precisely controlled motor operatively connected to a rotary-to-linear movement converting mechanism, said converting mechanism operatively connected to said conveyor to move said conveyor laterally.

8. The conveying system according to claim 7, wherein said rotary-to-linear movement converting mechanism comprises a crank arm having a base end operatively connected to said precisely controlled motor for rotation thereby and a pin carried by said crank arm at a distal end thereof; and said conveying surface carried by a frame, said frame guided for lateral sliding movement, said frame including a guide for receiving said pin, said guide extending longitudinally, orbital motion of said pin moving said frame laterally.

9. The conveying system according to claim 8, wherein said first mechanism comprises a further precisely controlled motor, and said conveying surface is located on an endless belt, said belt wrapped around front and rear rolls, said further precisely controlled motor operatively engaged to one of said rolls to circulate said endless belt.

10. The conveying system according to claim 9, wherein said precisely controlled motor and said further precisely controlled motor are precisely controlled by a programmable controller of the conveying system, said programmable controller synchronizing movement of said precisely controlled motor and said further precisely controlled motor to move said conveyor in forward and reverse in both the lateral and longitudinal direction to form a two-dimensional pattern of slices on said conveying surface.

11. A conveying system for a slicing apparatus, comprising:

a conveying surface arranged to receive slices from a slicing apparatus;

a first mechanism for moving said conveying surface in a longitudinal direction in both forward and reverse;

a second mechanism for moving said conveying surface in a lateral direction in both forward and reverse; and a control for coordinating movement of said first and second mechanisms to deposit a two dimensional pattern of slices on said conveying surface;

wherein said conveying surface is located on an endless belt conveyor, and said first mechanism comprises a motor for circulating said endless belt conveyor, and said second mechanism comprises a precisely controlled motor operatively connected to a crank mechanism, said crank mechanism operatively connected to said endless belt conveyor, rotation of said precisely controlled motor moves said conveyor to shift said conveying surface laterally.

12. The conveying system according to claim 11, wherein said two dimensional pattern of slices comprises an S-shaped pattern.

13. The conveying system according to claim 11, wherein said two dimensional pattern of slices comprises an X-shaped pattern.

14. The conveying system according to claim 11, wherein said two dimensional pattern of slices comprises a square-shaped pattern.

15. The conveying system according to claim 11, wherein said two dimensional pattern of slices comprises a diamond-shaped pattern.

16. The conveying system according to claim 11, wherein said two dimensional pattern of slices comprises a square/round-shaped pattern.

17. The conveying system according to claim 11, wherein said two dimensional pattern of slices comprises a circular-shaped pattern.

18. The conveying system according to claim 11, wherein said two dimensional pattern of slices comprises a triangle-shaped pattern.

19. A conveying system for a slicing apparatus, comprising:

a first roll and a second roll arranged in parallel and having lateral axis;

at least one belt wrapped around said first and second rolls;

a precisely controlled first motor operatively connected to one of said rolls to circulate said conveyor belt;

a precisely controlled second motor and a rotary-to-linear movement converting mechanism operatively connected to said second motor, said movement converting mechanism operatively connected to said conveyor frame; and a controller signal-connected to said first and second motors to coordinate precise longitudinal and lateral movement of said conveying surface to form two-dimensional patterns of slices deposited on said conveying surface from a relatively stationery slicing mechanism.

20. The method system according to claim 19, wherein said conveying surface is moved in said lateral direction in both forward and reverse.

21. The method system according to claim 19, wherein said conveying surface is moved in said longitudinal direction in both forward and reverse.

22. The system according to claim 19, wherein said conveying surface is moved to create said two dimensional pattern at a speed to produce shingling of slices in both the longitudinal and lateral direction.

23. The system according to claim 19, wherein said two dimensional pattern includes shingled slices in the lateral direction in both the forward and reverse directions.

24. The system according to claim 19, wherein said two dimensional pattern includes shingled slices in the longitudinal direction in both the forward and reverse directions.

25. The system according to claim 19, wherein said conveying surface is moved to create an S-shaped two dimensional pattern.

26. The system according to claim 19, wherein said conveying surface is moved to create an X-shaped two dimensional pattern.

27. The system according to claim 19, wherein said conveying surface is moved to create a square-shaped two dimensional pattern.

28. The system according to claim 19, wherein said conveying surface is moved to create a diamond-shaped two dimensional pattern.

29. The system according to claim 19, wherein said conveying surface is moved to create a square/round-shaped two dimensional pattern.

30. The system according to claim 19, wherein said conveying surface is moved to create a circular-shaped two dimensional pattern.

31. The system according to claim 19, wherein said conveying surface is moved to create a triangle-shaped two dimensional pattern.

32. The system according to claim 19, wherein said conveying surface is moved in both the longitudinal and lateral direction within each pattern to shingle slices in both the longitudinal and lateral directions.

33. The conveying system according to claim 19, wherein said rotary-to-linear movement converting mechanism comprises a vertical shaft driven into rotation about its axis by said second motor, and a crank arm fixed to an end of said shaft and a pin extending vertically from a distal end of said crank arm;

wherein said frame comprises a longitudinally extending channel that receives said pin, rotation of said shaft causing orbital movement of said pin to translate said channel and said frame laterally.

34. The conveying system according to claim 33, wherein said shaft is vertically extendable to compensate for change in elevation of said belt.

35. The conveying system according to claim 34, wherein said converting mechanism comprises a crank tube driven into rotation by said second motor, and said shaft is telescopically received in said crank tube, and keyed for rotation therewith, said shaft extendable from said crank tube to compensate for elevation change of said conveyor belt.

36. A conveying system for a slicing apparatus that produces slices from two different product loaves, said loaves arranged and sliced side-by-side, comprising:

a conveying surface arranged to receive slices from said loaves;

a first mechanism for moving said conveying surface in a longitudinal direction;

a second mechanism for moving said conveying surface in a lateral direction in both forward and reverse; and a control for coordinating movement of said first and second mechanisms to deposit slices from said two loaves on said conveying surface, wherein said conveyor is moved laterally repetitively and said loaves are sliced at a pre-selected rate to deposit alternating slices from the two loaves at substantially the same lateral position on the conveying surface to interleave slices of said first and second loaves in one or more stacks;

wherein said conveying surface is located on an endless belt, and said second mechanism comprises a precisely controlled motor operatively connected to a rotary-to-linear movement converting mechanism, said converting mechanism operatively connected to said conveyor to move said conveyor laterally.

37. The conveying system according to claim 36, wherein said rotary-to-linear movement converting mechanism comprises a crank arm having a base end operatively connected to said precisely controlled motor for rotation thereby and a pin carried by said crank arm at a distal end thereof; and said conveying surface carried by a frame, said frame guided for lateral sliding movement, said frame including a guide for receiving said pin, said guide extending longitudinally, orbital motion of said pin moving said frame laterally.

38. The conveying system according to claim 37, wherein said first mechanism comprises a further precisely controlled motor, and said conveying surface is located on an endless belt, said belt wrapped around front and rear rolls, said further precisely controlled motor operatively engaged to one of said rolls to circulate said endless belt.

39. The conveying system according to claim 36 wherein said control causes said first mechanism to move said conveying surface longitudinally to shingle said one or more stacks in a longitudinal direction.

* * * * *

UNITED STATES PATENT AND TRADEMARK OFFICE

CERTIFICATE OF CORRECTION

PATENT NO. : 6,763,750 B2
DATED : July 20, 2004
INVENTOR(S) : Scott A. Lindee

It is certified that error appears in the above-identified patent and that said Letters Patent is hereby corrected as shown below:

Column 6,
Line 65, change "3" to -- 1 --.

Column 8,
Line 65, delete "method".

Column 9,
Line 1, delete "method".

Signed and Sealed this

Twenty-fourth Day of May, 2005

JON W. DUDAS
*Director of the United States Patent and Trademark Office*